US008591276B2

(12) United States Patent
Ochiai

(10) Patent No.: US 8,591,276 B2
(45) Date of Patent: Nov. 26, 2013

(54) METHOD OF MANUFACTURING CENTER ELECTRODE AND SPARK PLUG

(75) Inventor: Satoru Ochiai, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 27 days.

(21) Appl. No.: 13/308,921

(22) Filed: Dec. 1, 2011

(65) Prior Publication Data

US 2012/0142244 A1 Jun. 7, 2012

(30) Foreign Application Priority Data

Dec. 3, 2010 (JP) ..... 2010-270448

(51) Int. Cl.
*H01T 21/02* (2006.01)

(52) U.S. Cl.
USPC ..... 445/7

(58) Field of Classification Search
USPC ..... 445/7; 313/118–119
See application file for complete search history.

(56) References Cited

U.S. PATENT DOCUMENTS

2006/0028108 A1* 2/2006 Okabe et al. ..... 313/143

FOREIGN PATENT DOCUMENTS

JP 8213150 8/1996 ..... H01T 13/20

OTHER PUBLICATIONS

English Translation of JP 8-213150 A to Ando Minoru (Aug. 20, 1996).*

* cited by examiner

*Primary Examiner* — Anh Mai
*Assistant Examiner* — Hana Featherly
(74) *Attorney, Agent, or Firm* — Kusner & Jaffe

(57) ABSTRACT

A method of manufacturing a center electrode of a spark plug, comprising the steps of forming a cylindrical electrode member having a medium diameter portion and a small diameter portion and forming a barrel portion by extruding the medium diameter portion when the value of (S1−S2)/S1×100) is 30 or more, S1 being the cross-sectional area of a cross-section of the medium diameter portion perpendicular to an axial direction, and S2 being the cross-sectional area of a cross-section of each small diameter portion perpendicular to the axial direction.

2 Claims, 9 Drawing Sheets

STEP A
61
62
60

STEP B
63
CUT OFF

STEP C
66
64
65

STEP D
67
65

STEP E
CUT OFF

STEP F
68
65
φa1

STEP G
φa2
69
65
26
φc

STEP H
70
69
φa1
65
26

STEP I
69
23
24
25
26
φb

| CROSS-SECTION REDUCTION RATE R(%) | BULGE AMOUNT E (mm) |
|---|---|
| 10 | 0.004 |
| 20 | 0.006 |
| 30 | 0.011 |
| 40 | 0.018 |
| 45 | 0.024 |
| 50 | 0.029 |
| 55 | 0.035 |
| 60 | 0.041 |

REFERENCE DIAGRAM

METHOD OF MANUFACTURING CENTER ELECTRODE AND SPARK PLUG

FIELD OF THE INVENTION

The present invention relates to a technology of manufacturing a center electrode and spark plug.

BACKGROUND OF THE INVENTION

A center electrode of a spark plug, in general, includes a flange-like large diameter portion at a rear end side portion of the center electrode. The leading end side of the large diameter portion includes a barrel portion that is smaller in diameter than the large diameter portion and a small diameter portion that is smaller in diameter than the barrel portion. Heretofore, when manufacturing this kind of center electrode having multi-step diameters, a cylindrical electrode member is first prepared, and then the barrel portion is formed by an extrusion process, after which a small diameter portion is formed at the leading end portion of the barrel portion by an extrusion (for example, refer to JP-A-8-213150).

However, depending on a difference between the diameter of the barrel portion and the diameter of the small diameter portion, the barrel portion may bulge in a radial direction due to a pressure applied to the rear end of the electrode member by a punch when extruding the small diameter portion.

SUMMARY OF THE INVENTION

An object which the invention is to achieve, bearing in mind the heretofore described problem, is to provide a technology with which it is possible to accurately form a barrel portion of a center electrode of a spark plug.

The invention, having been conceived in order to achieve at least one portion of the object, can be realized as the following aspect or application example.

Application Example

In accordance with the present invention, there is provided a method of manufacturing a center electrode for a spark plug having an insulator with an axial hole extending therethrough in an axial direction. The axial hole has an in-axial-hole shoulder which reduces the diameter of the axial hole from a rear end side toward a leading end side in the axial direction. A metal shell is disposed on the outer periphery of the insulator. The center electrode includes a large diameter portion which is inserted into the axial hole from the axial direction rear end side, and abuts against the in-axial-hole shoulder, a barrel portion which is smaller in diameter than the large diameter portion, and is disposed closer to the axial direction leading end side than the large diameter portion, and small diameter portions which are disposed closer to the leading end side than the barrel portion and are smaller in diameter than the barrel portion. The method of manufacturing includes a first step of preparing a cylindrical electrode member as the material of the center electrode; a second step of forming a medium diameter portion larger in diameter than the small diameter portions, from the leading end to rear end of the electrode member, using an extrusion; a third step of forming the small diameter portions and on the leading end side of the medium diameter portion using an extrusion after the second step; and a fourth step of, when the cross-sectional area of a cross section of the medium diameter portion perpendicular to the axial direction is taken to be S1, and the cross-sectional area of a cross section of each small diameter portion perpendicular to the axial direction is taken to be S2, forming the barrel portion by extruding the medium diameter portion after the third step when the value of $((S1-S2)/S1\times 100)$ is 30 or more.

With this kind of method of manufacturing the center electrode of the spark plug, when a cross-section reduction rate $(=(S1-S2)/S1\times 100)$ when the small diameter portions are formed on the leading end side of the medium diameter portion is 30% or more, the barrel portion is formed by further extruding the medium diameter portion after the formation of the small diameter portions. Because of this, it is possible to accurately form the barrel portion of the center electrode. As a result of this, it is possible to prevent, for example, a crack occurring in the insulator due to a bulge of the barrel portion. Also, as it is possible to size uniform by the diameter of the barrel portion in the axial direction, it is possible to improve the conductivity of heat from the center electrode to the insulator, enabling a suppression of an abnormal heat generation of the center electrode.

The invention, apart from the method of manufacturing center electrode of the spark plug, can also be configured as a method of manufacturing the spark plug, or as the center electrode or spark plug itself.

DETAILED DESCRIPTION OF THE EMBODIMENTS

A. Overall Configuration of Spark Plug

Figure 1:
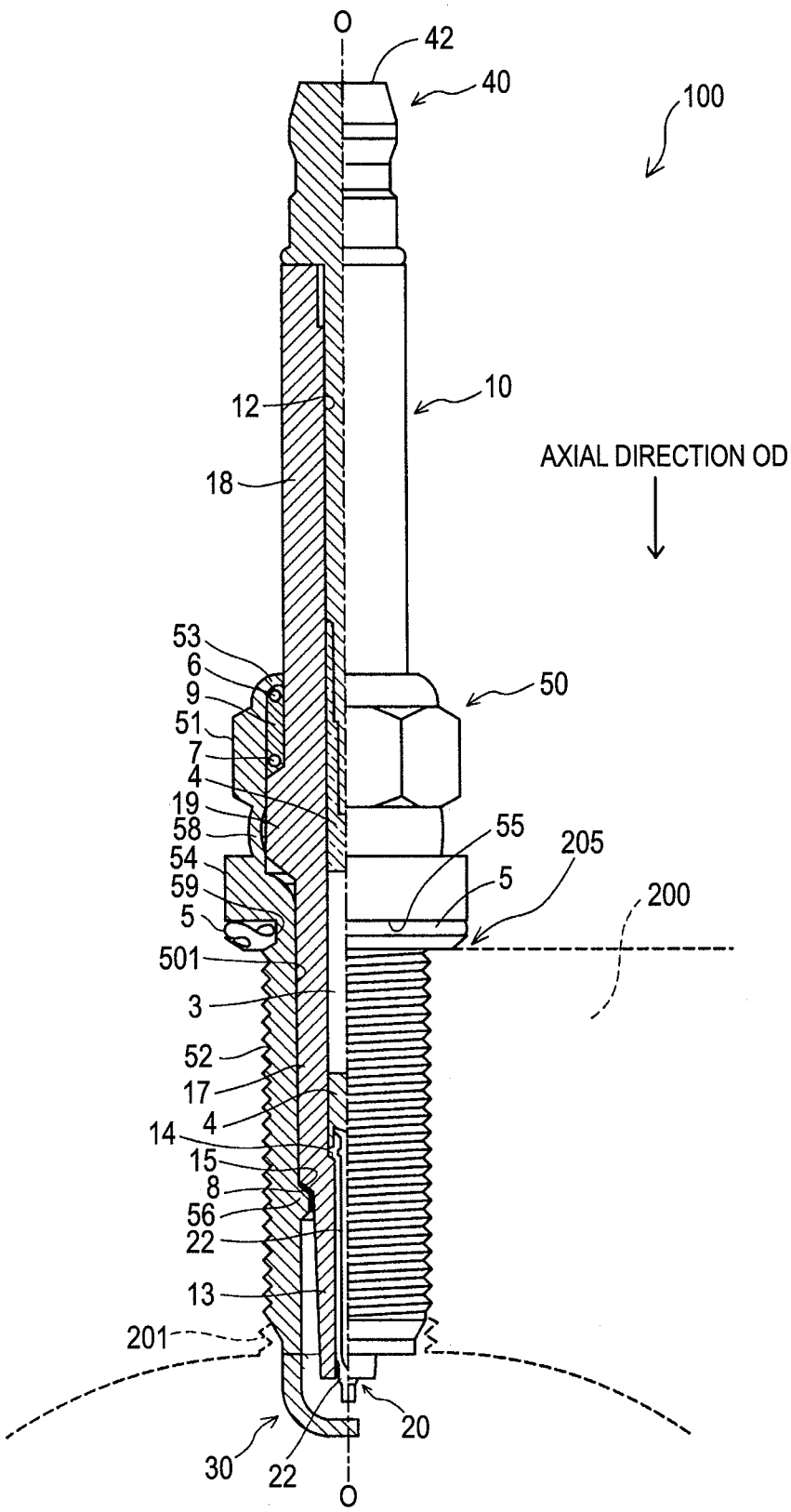
FIG. 1 is a fragmentary sectional view of a spark plug as an embodiment of the invention.

FIG. 1 is a fragmentary sectional view of a spark plug 100 as an embodiment of the invention. In FIG. 1, the right side of an axis O-O shown by the dashed-dotted line presents an external front view, and the left side of the axis O-O presents a sectional view of the spark plug 100 taken on a plane passing through the central axis of the spark plug 100. Hereafter, a description will be given with an axial direction OD of the spark plug 100 in FIG. 1 as an up-down direction in each drawing, the lower side as the leading end side of the spark plug 100, and the upper side as the rear end side.

The spark plug 100 includes an insulator 10 as an insulating body, a metal shell 50, a center electrode 20, a ground electrode 30, and a terminal 40. The metal shell 50 has formed therein an insert hole 501 passing therethrough in the axial direction OD. The insulator 10 is inserted and held in the insert hole 501. The center electrode 20 is held in the axial direction OD in an axial hole 12 formed in the insulator 10. The leading end portion of the center electrode 20 is exposed on the leading end side of the insulator 10. The ground electrode 30 is joined to the leading end portion of the metal shell 50. The terminal 40 is provided on the rear end side of the center electrode 20, and the rear end portion of the terminal 40 is exposed on the rear end side of the insulator 10.

The insulator 10 is formed by sintering alumina or the like, as well known. Insulator 10 has a hollow cylindrical shape in which the axial hole 12 extending in the axial direction OD is formed centered on the axis. A flange portion 19 of a largest outside diameter is formed in approximately the center of the insulator 10 in the axial direction OD, and a rear end side barrel portion 18 is formed closer to the rear end side than the flange portion 19. A leading end side barrel portion 17 of an outside diameter smaller than that of the rear end side barrel portion 18, is formed closer to the leading end side than the flange portion 19. An insulator nose length portion 13 of an outside diameter smaller than that of the leading end side barrel portion 17 is formed still closer to the leading end side than the leading end side barrel portion 17. The insulator nose length portion 13 decreases in diameter toward the leading end side, and is exposed in a combustion chamber of an internal combustion engine when the spark plug 100 is mounted in an engine head 200 of the internal combustion engine.

The metal shell 50 is a hollow cylindrical metallic part for fixing the spark plug 100 in the engine head 200 of the internal combustion engine. The metal shell 50 holds the insulator 10 in such a way so as to surround a region of the insulator 10 from one portion of the rear end side barrel portion 18 of the insulator 10 to the insulator nose length portion 13. That is, the metal shell 50 is configured in such a way that the insulator 10 is inserted into the insert hole 501 of the metal shell 50, and the leading end and rear end of the insulator 10 are exposed from the leading end and rear end respectively of the metal shell 50. The metal shell 50, being formed from low-carbon steel, is plated all over with nickel, zinc, or the like. A tool engagement portion 51 of a hexagonal prism shape with which a spark plug wrench (not shown) is engaged is provided at the rear end portion of the metal shell 50. The metal shell 50 includes a mounting threaded portion 52, on which screw threads are formed, for threaded engagement with a mounting threaded bore 201 of the engine head 200 provided in an upper portion of the internal combustion engine.

A flange-like seal portion 54 is formed between the tool engagement portion 51 and mounting threaded portion 52 of the metal shell 50. An annular gasket 5, formed by bending a plate body, is fitted over a thread neck 59 between the mounting threaded portion 52 and seal portion 54. The gasket 5 changes in shape by being squeezed by a seating surface 55 of the seal portion 54 and an opening peripheral portion 205 of the mounting threaded bore 201 when the spark plug 100 is mounted in the engine head 200. A space between the spark plug 100 and engine head 200 is sealed by the change in shape of the gasket 5, preventing an air leakage from within the internal combustion engine via the mounting threaded bore 201.

A thin-walled caulked portion 53 is provided closer to the rear end side than the tool engagement portion 51 of the metal shell 50. Also, a compressively deformed portion 58 as thin-walled as the caulked portion 53 is provided between the seal portion 54 and tool engagement portion 51. Circular ring members 6 and 7 are interposed between an inner peripheral surface of the metal shell 50 and an outer peripheral surface of the rear end side barrel portion 18 of the insulator 10, each of which ranges from the tool engagement portion 51 to the caulked portion 53. A space between the two ring members 6 and 7 is filled with talc 9 powder. When manufacturing, the compressively deformed portion 58 is compressively deformed by the caulked portion 53 being pressed toward the leading end side in such a way as to be bent inward and, owing to the compressive deformation of the compressively deformed portion 58, the insulator 10 is pressed toward the leading end side, in the metal shell 50, across the ring members 6 and 7 and talc 9. Owing to the pressure, an insulator shoulder 15 positioned at the base end of the insulator 10 nose length portion 13 is pressed across an annular plate packing 8 against an in-metal-shell shoulder 56 formed in a position of the mounting threaded portion 52 on the inner periphery of the metal shell 50, thus integrating the metal shell 50 and insulator 10. At this time, the airtightness between the metal shell 50 and insulator 10 is maintained by the plate packing 8, preventing an outflow of combustion gas. Also, owing to the pressure, the talc 9 is compressed in the axial direction OD, increasing the airtightness in the metal shell 50.

Figure 2:
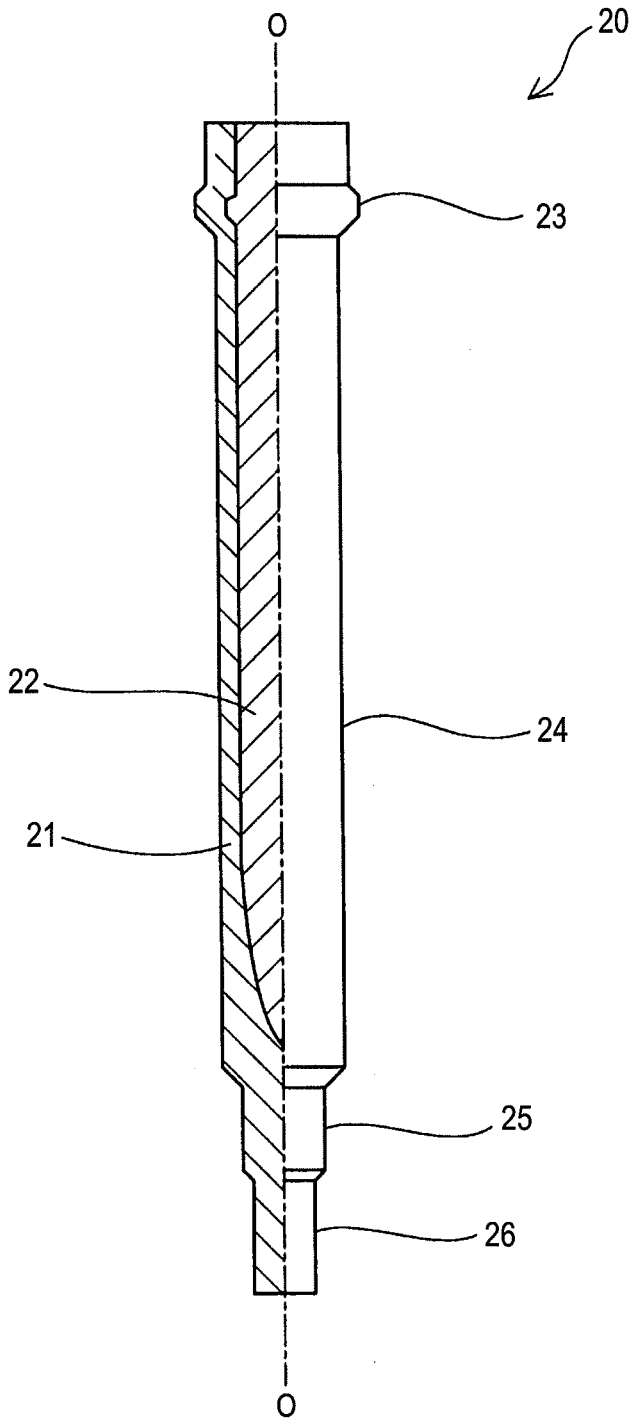
FIG. 2 is a fragmentary sectional view of a center electrode.

FIG. 2 is a fragmentary sectional view of the center electrode 20. The center electrode 20 is a bar-like electrode having a structure wherein a core 22 made of copper or a copper-based alloy, superior in thermal conductivity to an electrode base material 21. Core 22 is buried inside the electrode base material 21, which is formed from nickel or a nickel-based alloy, such as Inconel (trade name) 600. A flange-like large diameter portion 23 is formed in a rear end portion of the center electrode 20. Flange-like large diameter portion 23 is placed in position by abutting from the rear end side against an in-axial-hole shoulder 14 which reduces the diameter of the axial hole 12 from the rear end side toward the leading end side. A barrel portion 24, smaller in diameter than the large diameter portion 23, is formed on the leading end side of the large diameter portion 23. Also, a first small diameter portion 25, smaller in diameter than the barrel portion 24, is formed closer to the leading end side than the barrel portion 24, and a second small diameter portion 26, smaller in diameter than the first small diameter portion 25, is formed still closer to the leading end side than the first small diameter portion 25. The second small diameter portion 26 is protruded on the leading end side beyond the leading end of the insulator 10, and forms a spark gap with the ground electrode 30, to be described hereafter. The barrel portion 24 is disposed closer to the leading end side than the in-axial-hole shoulder 14 in the axial hole 12. That is, the larger portion of the barrel 24 is disposed in the insulator 10 nose length portion 13. The center electrode 20 with this kind of structure is disposed closest to the leading end side in the axial hole 12 of the insulator 10, and a glass seal body 4 and a ceramic resistor 3 are disposed on the rear end side of the center electrode 20. Then, the center electrode 20 is electrically connected to the terminal 40, disposed at the rear end of the axial hole 12, via the glass seal body 4 and ceramic resistor 3. A high voltage cable (not shown) is connected to the terminal 40 via a plug cap (not shown), and a high voltage is applied to the terminal 40.

The ground electrode 30 (FIG. 1) is configured from a metal with high corrosion resistance, and a nickel alloy is used as one example of the metal. The base end of the ground electrode 30 is welded to the leading end face of the metal shell 50. The leading end portion of the ground electrode 30 is bent so as to be opposed, on the axis O-O, to the leading end face of the center electrode 20 in the axial direction OD.

B. Method of Manufacturing Center Electrode

Figures 3A, 3B, 3C, 3D, 3E, 3F, 3G, 3H, 3I:
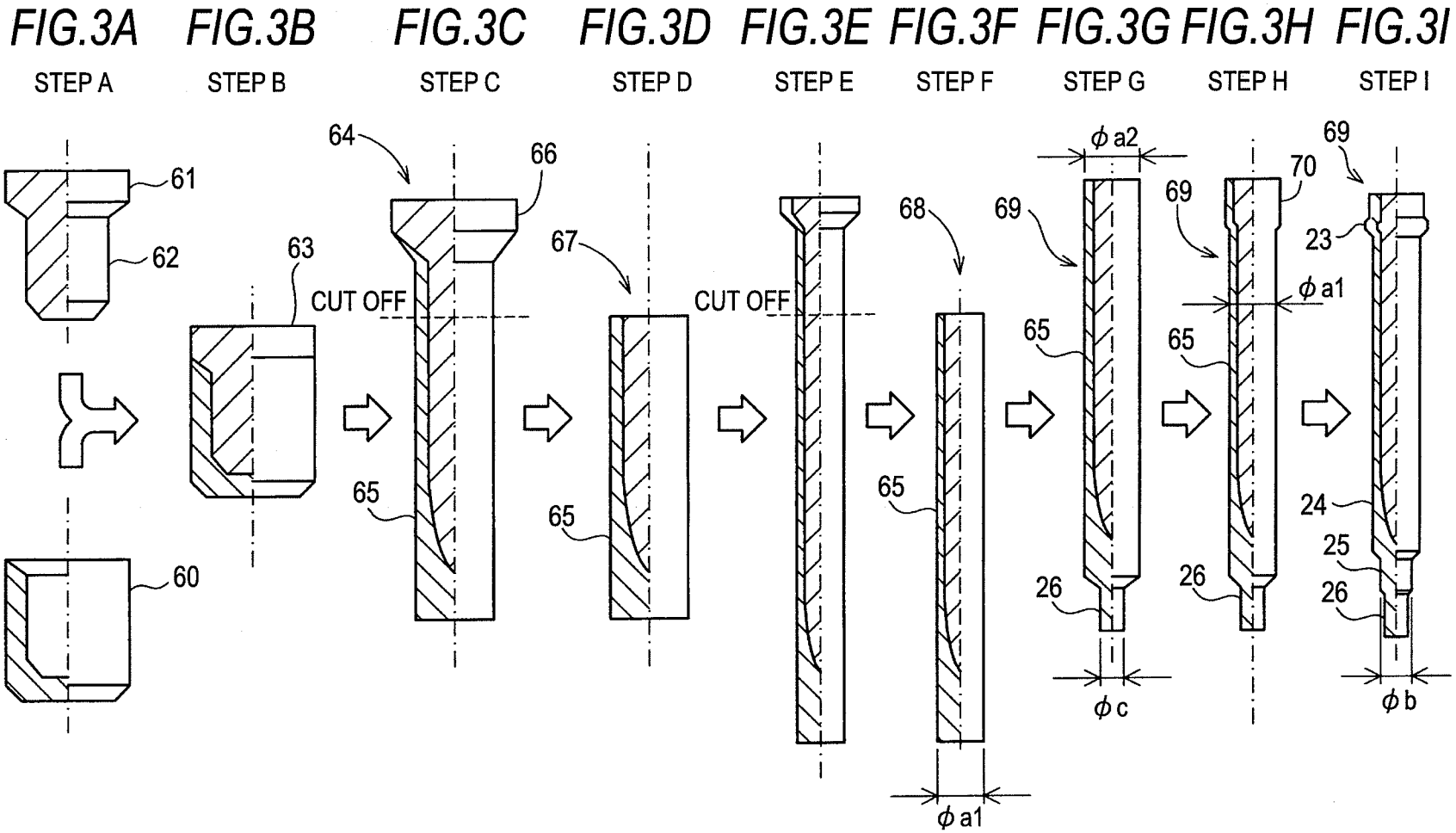
FIGS. 3A to 3I are illustrations showing all steps of a method of manufacturing the center electrode.

A method of manufacturing the center electrode 20 in the embodiment shall now be described with reference to FIGS. 3A to 8B. FIGS. 3A to 3I are illustrations showing all steps of the method of manufacturing the center electrode 20. With the method of manufacturing the center electrode 20 in the embodiment, firstly, as shown in FIG. 3A, a wire rod of nickel, a nickel alloy, or the like, superior in thermal resistance and corrosion resistance is cut to a predetermined length, and a bottomed cylindrical cup member 60 is formed by carrying out a cold forging. Then, furthermore, a wire rod of copper, a copper alloy, or the like, superior in thermal conductivity to the cup member 60 is cut to a predetermined length, and a columnar shaft center 62 having a flange-like head portion 61 at the rear end is formed by carrying out a cold forging (step A). On the cup member 60 and shaft center 62 being formed in this way, the shaft center 62 is pressed into the cup member 60 with a predetermined load (step B). By so doing, a first composite material 63 is formed, as shown in FIG. 3B. The cup member 60 is the source of the electrode base material 21 shown in FIG. 2, and the shaft center 62 is the source of the core 22 shown in FIG. 2. In each extrusion step, to be described hereafter, a lubricant is injected into an extrusion die as necessary.

Figure 4A:
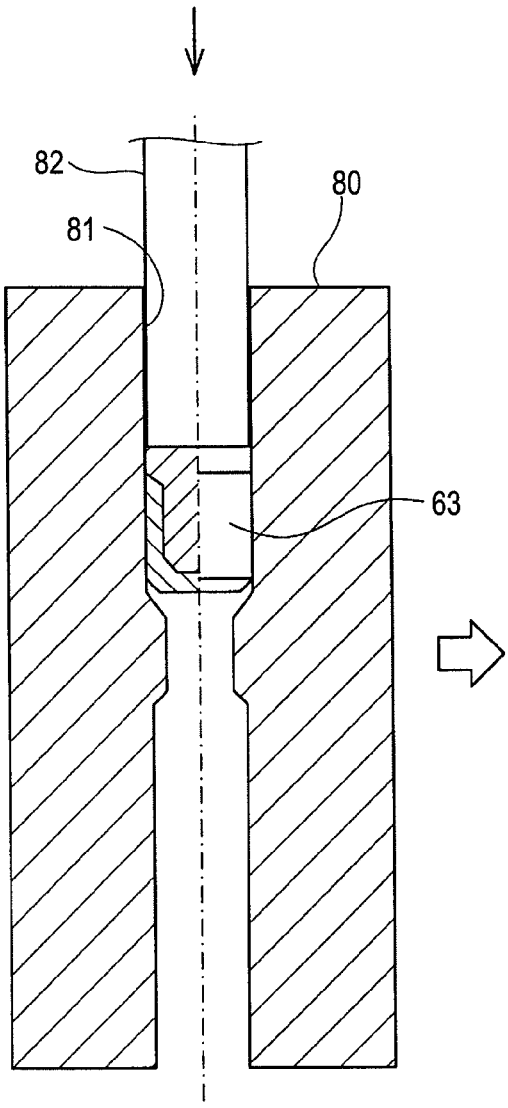
FIGS. 4A and 4B are illustrations showing how to form an extruded body.
Figure 4B:
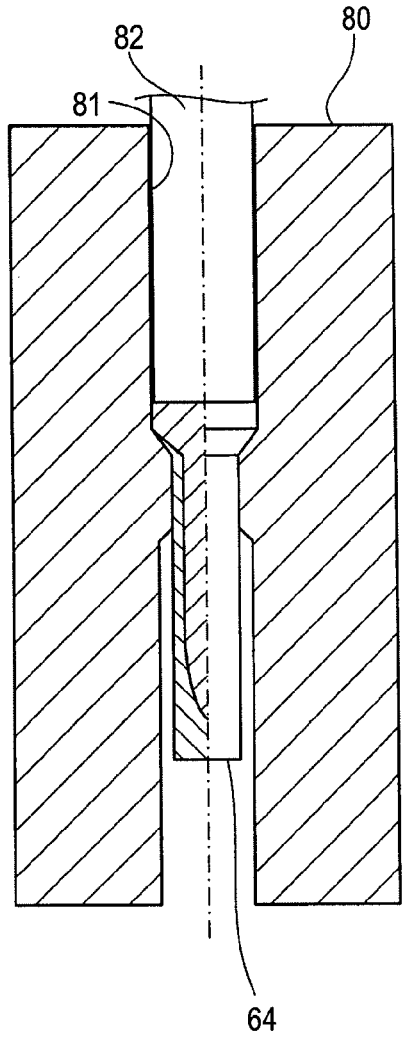

On the first composite material 63 being generated, as shown in FIGS. 4A and 4B, the first composite material 63 is inserted into a round, cylindrical hole 81 of an extrusion die 80, and extruded by being pressed in by a punch 82 (step C). By so doing, the leading end side portion of the first composite material 63 is reduced in diameter, forming a round bar-like extruded body 64, as shown in FIG. 3C. A round bar-like medium diameter portion 65 smaller in diameter than the first composite material 63 is formed in the leading end side portion of the extruded body 64, and a flange-like head portion 66 not extruded is formed in the rear end side portion. On the extruded body 64 being removed from the extrusion die 80, one rear end side portion of the extruded body 64 including the head portion 66 is cut off, thereby forming a second composite material 67 formed of the medium diameter portion 65, as shown in FIG. 3D (step D). The second composite material 67 corresponds to a "cylindrical electrode member" in an application example, and the step A to step D correspond to "first step."

In the embodiment, as shown in FIGS. 3E and 3F, the extruded body 64 is further extruded and reduced in diameter (step E), and the head portion thereof is cut off (step F), thereby generating a third composite material 68 of which the medium diameter portion 65 has a diameter a1 (for example, 1.9 mm). The step E and step F correspond to "second step" in the application example.

Figure 5A:
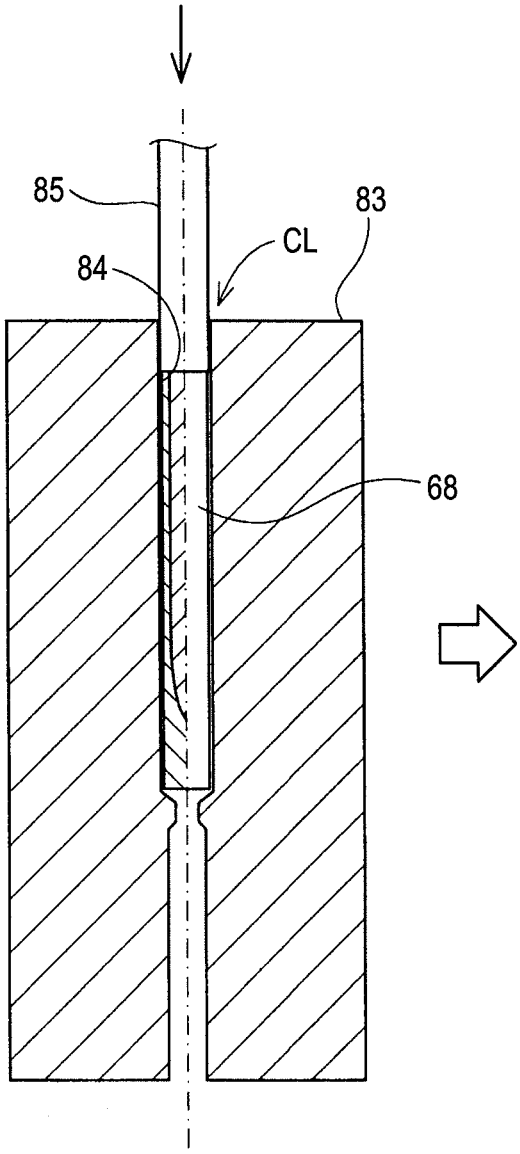
FIGS. 5A and 5B are illustrations showing how to form a fourth composite material.
Figure 5B:
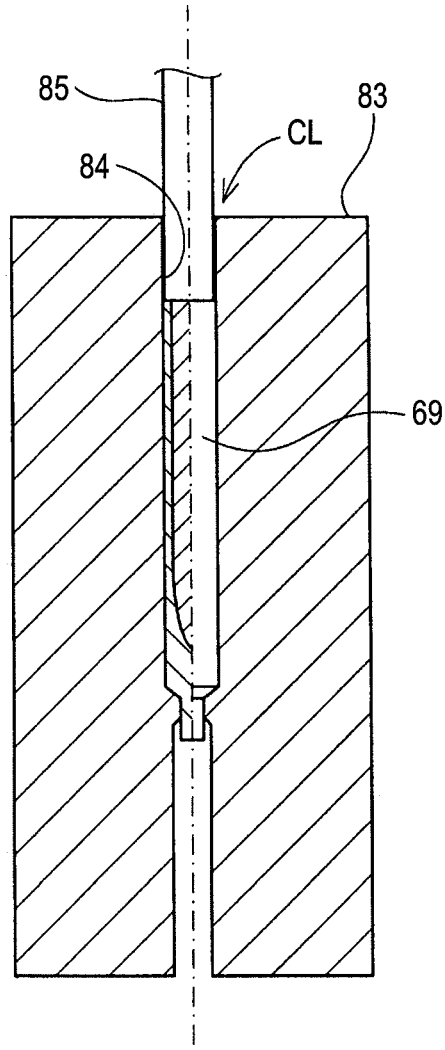

On the third composite material 68 being generated, the third composite material 68 is inserted into a round hole 84 of an extrusion die 83, and extruded by being pressed in by a punch 85, thus further reducing the diameter of the leading end portion of the medium diameter portion 65, as shown in FIGS. 5A and 5B (step G). By so doing, a fourth composite material 69 having the second small diameter portion 26 of a diameter c (for example, 1.6 mm) is formed at the leading end of the medium diameter portion 65, as shown in FIG. 3G. The step G corresponds to a "third step" in the application example.

In the step G, when the second small diameter portion 26 is formed at the leading end of the medium diameter portion 65, a phenomenon may occur wherein the medium diameter portion 65 of the fourth composite material 69 bulges toward the outer periphery in a slight clearance CL (FIG. 5) between the round hole 84 of the extrusion die 83 and the fourth composite material 69 due to a load from the punch 85, and the diameter of the medium diameter portion 65 becomes a diameter a2 larger than the diameter a1 partially (in many cases, at the rear end portion) or as a whole. In the embodiment, a re-forming process for returning the diameter of the medium diameter portion 65 of the fourth composite material 69 from the diameter a2 to the diameter a1 is carried out in order that the amount of the bulge E (the difference between the diameter a2 and diameter a1) is kept within a predetermined tolerance (in the embodiment, 0.010 mm) (step H). The step H corresponds to a "fourth step" in the application example.

Figure 6A:
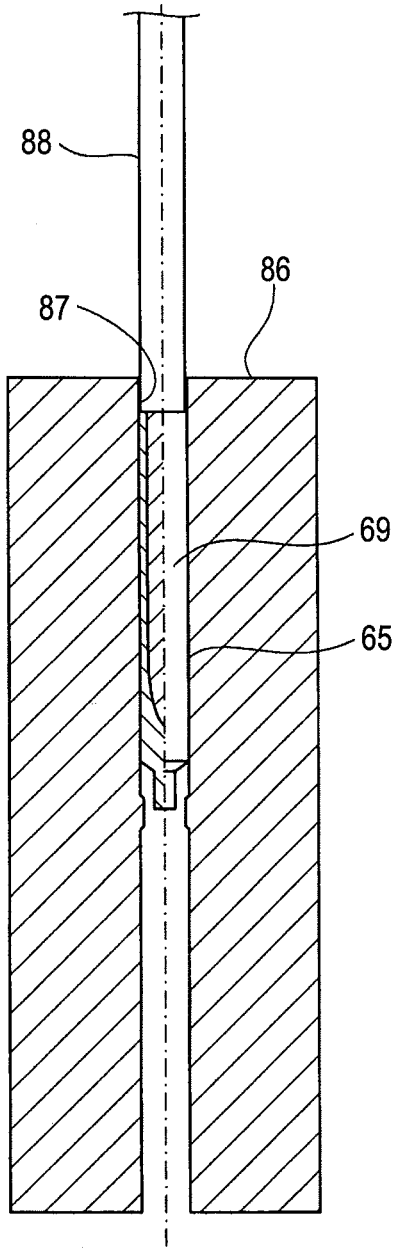
FIGS. 6A and 6B are illustrations showing how to carry out a re-forming process.
Figure 6B:
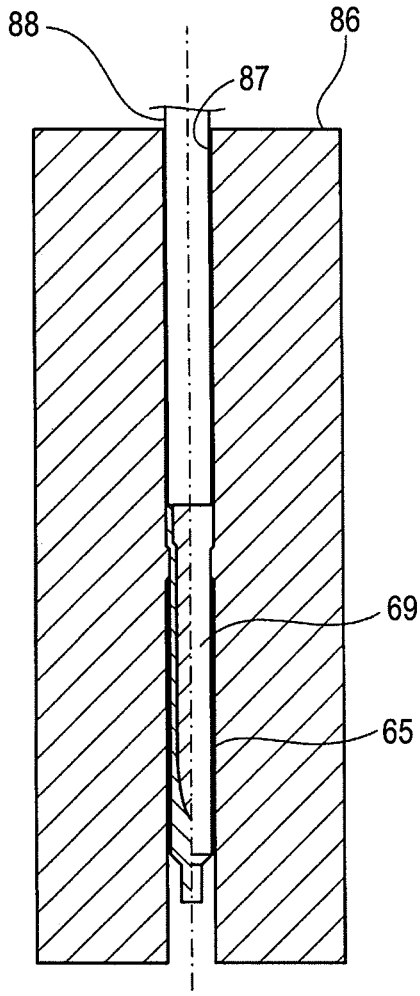

FIGS. 6A and 6B are illustrations showing how to carry out the re-forming process. In the embodiment, as shown in FIGS. 6A and 6B, the fourth composite material 69 is inserted into a round hole 87 of an extrusion die 86 and pressed in by a punch 88, and by thus extruding the medium diameter portion 65, the diameter of the medium diameter portion 65 is re-formed into the diameter a1 from the diameter a2. By so doing, it is possible to suppress a bulge of the medium diameter portion 65 retroactively. The medium diameter portion 65 re-formed in this way forms the barrel portion 24 of the center electrode 20 in FIG. 2.

In the embodiment, the re-forming process is carried out when a cross-section reduction rate R of the medium diameter portion 65 when forming the second small diameter portion 26 is 30% or more. The cross-section reduction rate R is expressed by the following equation 1 when the cross-sectional area of a cross section perpendicular to the axial direction of the medium diameter portion 65 before the second small diameter portion 26 is formed thereon is taken to be S1 ($=\pi(a1/2)^2$), and the cross-sectional area of a cross section of the second small diameter portion 26 perpendicular to the axial direction is taken to be S2 ($=\pi(a2/2)^2$).

$$R[\%]=(S1-S2)/S1\times 100 \qquad \text{Equation 1}$$

Figures 7A, 7B:
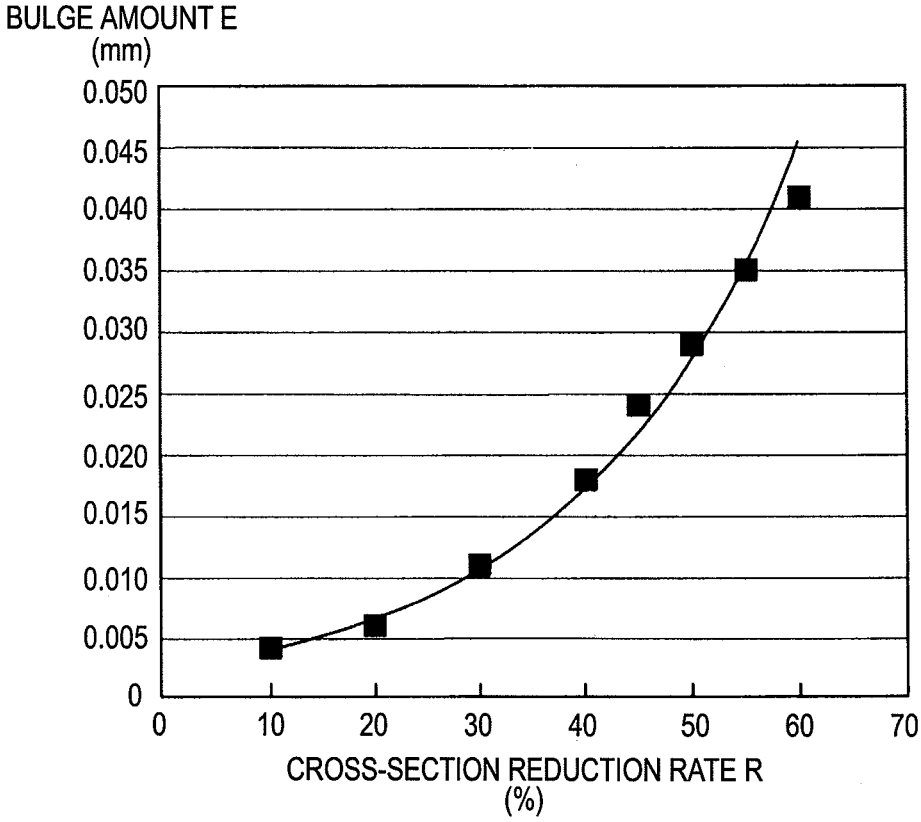
FIGS. 7A and 7B are illustrations showing a relationship between a cross-section reduction rate and bulge amount.

FIGS. 7A and 7B are illustrations showing a relationship between the cross-section reduction rate R and bulge amount E. The relationship between the cross-section reduction rate R and bulge amount E is shown in tabular form in FIG. 7A, and in graph form in FIG. 7B. Herein, the bulge amounts E in accordance with the cross-section reduction rates R of various samples wherein the diameter a1 of the medium diameter portion 65 of the third composite material 68 ranges from 1.5 mm to 3.0 mm are obtained by experiments. Each bulge amount E shown in FIGS. 7A and 7B is the mean value of the bulge amounts E of the samples at the cross-section reduction rates R. According to the experimental results shown in FIGS. 7A and 7B, it is confirmed that when the cross-section reduction rate R exceeds 30%, the bulge amount E is generally larger than the tolerance (0.010 mm) in the embodiment. Because of this, in the embodiment, as heretofore described, the re-forming process is carried out when the cross-section reduction rate R exceeds 30%. When manufacturing the center electrode 20 with a cross-section reduction rate R of less than 30%, it is possible to omit the re-forming process in the step H of FIG. 3H. Of course, it is also possible to carry out the re-forming process uniformly regardless of the cross-section reduction rate R.

Figure 8A:
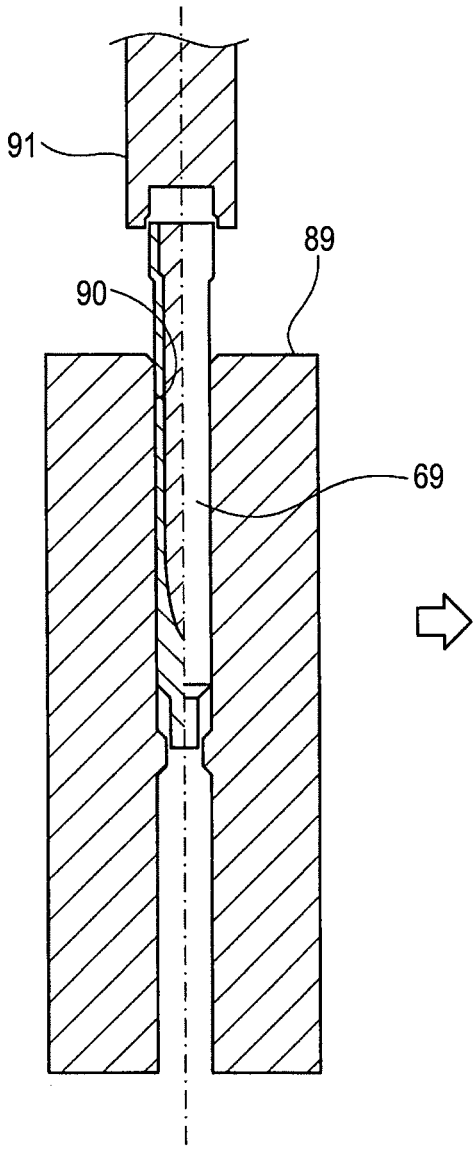
FIGS. 8A and 8B are illustrations showing a final step of a method of manufacturing the spark plug.
Figure 8B:
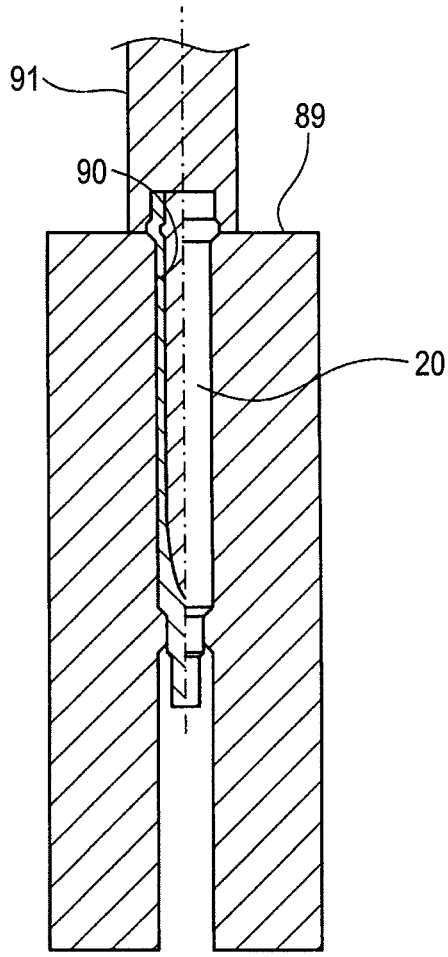

When the re-forming process is finally finished, as shown in FIGS. 8A and 8B, the fourth composite material 69 is inserted into a round hole 90 of an extrusion die 89 for forming the first small diameter portion 25, and is extruded by being pressed in by a punch 91. A die for forming the large diameter portion 23 of the center electrode 20 (step I in FIG. 3I) is formed on the leading end face of punch 91. By so doing, the first small diameter portion 25 of a diameter b (for example, 1.7 mm) is smaller than that of the medium diameter portion 65 and is larger than that of the second small diameter portion 26. First small diameter portion 25 is formed between the medium diameter portion 65 and second small diameter portion 26 of the fourth composite material 69. The large diameter portion 23 is formed at the rear end of the medium diameter portion 65. In the embodiment, the step I is carried out with a slight bulge 70 formed at the rear end of the fourth composite material 69 still remaining in the re-forming process of the step H, but may be carried out after the bulge 70 is cut off.

The fourth composite material 69 manufactured in the way heretofore described is used as the center electrode 20 shown in FIG. 2 in manufacturing the spark plug 100. Specifically, the center electrode 20 is inserted into the axial hole 12 of the insulator 10 from the rear end side. A glass seal material is inserted from above the center electrode 20. The terminal 40 is pressed in from above the glass seal material. Subsequently, the insulator 10 is mounted in the metal shell 50 to which the bar-like ground electrode 30 has been welded in advance. The space between the insulator 10 and the caulked portion 53 of the metal shell 50 is packed with the ring members 6 and 7 and talc 9, and the caulked portion 53 is caulked from the rear end side. Finally, the ground electrode 30 is bent, thereby completing the spark plug 100.

As heretofore described, with the method of manufacturing the center electrode 20 in the embodiment, after the second small diameter portion 26 is formed at the leading end of the medium diameter portion 65 of the cylindrical third composite material 68 (FIG. 3F), the medium diameter portion 65 is re-formed, thereby forming the barrel portion 24 of the center electrode 20. Because of this, it is possible to substantially improve the dimensional accuracy of the diameter of the barrel portion 24 of the central electrode 20. As a result of this, it is possible to prevent, for example, a crack occurring in the insulator 10 due to a bulge of the barrel portion 24. Also, as it is possible to uniform the diameter of the barrel portion 24 in the axial direction, it is possible to improve the conductivity of heat from the center electrode to the insulator, enabling a suppression of an abnormal heat generation of the center electrode.

Also, in the embodiment, as the re-formation of the medium diameter portion 65 is carried out in the way heretofore described, it is possible to secure a sufficient clearance of the round hole of the extrusion die with which the medium diameter portion 65 is formed in the step F of FIG. 3F. Because of this, it is possible to reduce frictional resistance when extruding. As a result of this, it is possible to easily form the third composite material 68, and it is possible to reduce a load placed on the extrusion die.

In addition, in the embodiment, as the medium diameter portion 65 is re-formed in the way heretofore described, the dimensional accuracy of the outside diameter of the fourth composite material 69 inserted into the extrusion die 89 for implementing the final step I is improved. Because of this, defective insertions of the fourth composite material 69 into the extrusion die 89 decrease, enabling an improvement in yield.

Figure 9:
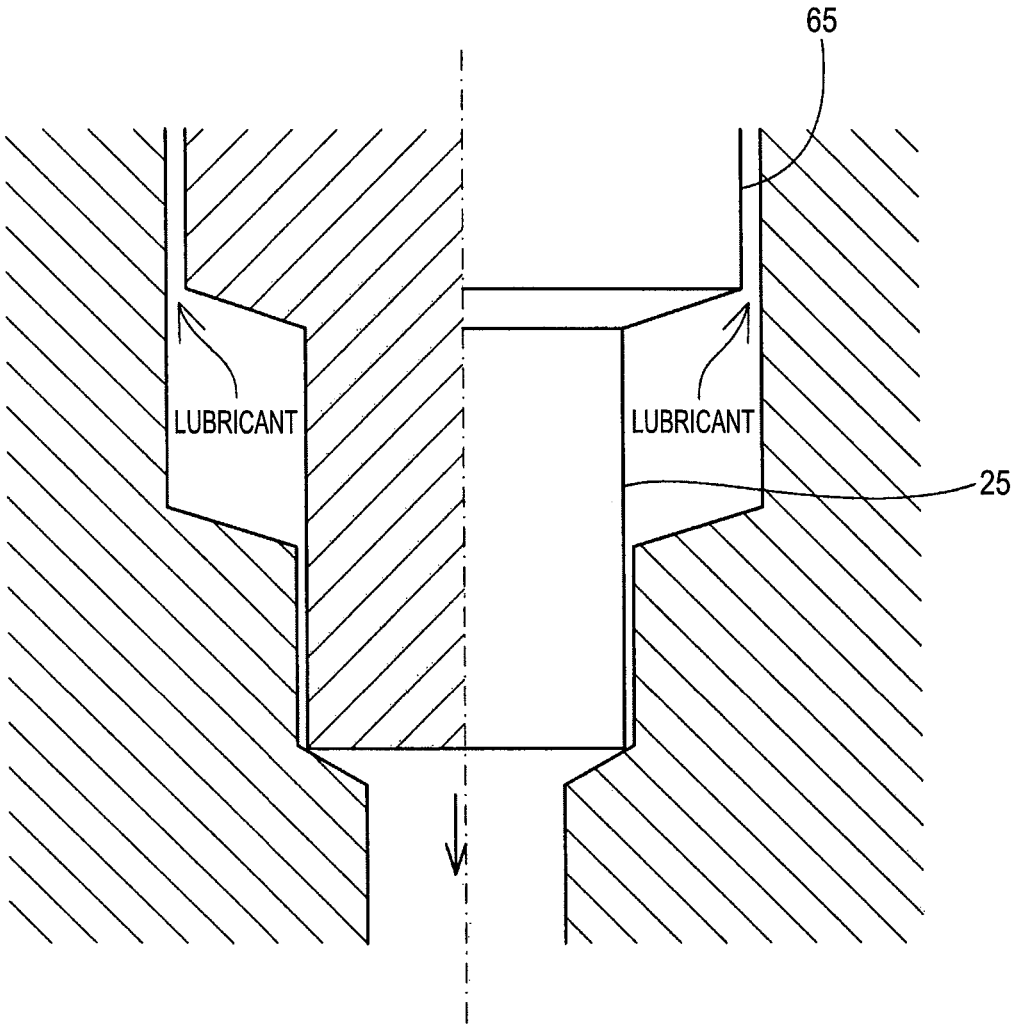
FIG. 9 is a reference diagram showing a phenomenon wherein a lubricant in an extrusion die is pushed back to the side surface of a medium diameter portion.

Moreover, in the embodiment, the second small diameter portion 26, which is smaller in diameter and is positioned closer to the leading end side than the first small diameter portion 25, is formed before the first small diameter portion 25. Because of this, it is possible to suppress, for example, a phenomenon, which may occur when the first small diameter portion 25 is formed earlier, wherein a lubricant in the extrusion die is pushed back to the side surface of the medium diameter portion 65, as shown in FIG. 9. As a result of this, it is possible to prevent the side surface of the medium diameter portion 65 from narrowing due to the existence of the lubricant.

C. Modification Examples

Heretofore, a description has been given of one embodiment of the invention, but the invention, not being limited to this kind of embodiment, can adopt various forms without departing from the scope thereof. For example, each kind of dimension and tolerance in the heretofore described embodiment is illustrative, and can be appropriately set in accordance with the specifications of the spark plug 100. In addition, the following kinds of modification are possible.

In the heretofore described embodiment, after the second small diameter portion 26 is formed on the leading end side of the medium diameter portion 65 of the third composite material 68, the re-forming process of returning the diameter a2 of the bulged medium diameter portion 65 to the original diameter a1 is carried out. As opposed to this, the diameter of the third composite material 68 before the re-forming process may be a diameter larger than the diameter a1 after the re-forming process. That is, a configuration may be adopted wherein the diameter of the medium diameter portion 65 is formed to be slightly large in steps E and F of FIGS. 3E and 3F, and the diameter of the medium diameter portion 65 is accurately formed in the step H after the formation of the second small diameter portion 26.

In the heretofore described embodiment, the second small diameter portion 26 is formed earlier than the first small diameter portion 25, but the first small diameter portion 25 may be formed earlier. In this case, it is preferable to regulate the dimensions of the composite materials and dies so that a reduction in diameter of the side surface of the medium diameter portion 65 does not occur due to the heretofore described pushing back of the lubricant.

In the heretofore described embodiment, two steps, the first small diameter portion 25 and second small diameter 26, are formed on the center electrode 20, but it is also possible to omit one of them. Also, three or more steps may be formed.

In the heretofore described embodiment, two extrusions are carried out in order to obtain the third composite material 68. As opposed to this, the third composite material 68 may be formed by one extrusion. Of course, it is also possible to form the third composite material 68 using three or more extrusions.

Having described the invention, the following is claimed:

1. A method of manufacturing a center electrode of a spark plug including:

an insulator having an axial hole extending in an axial direction, the axial hole having an in-axial-hole shoulder which reduces the diameter of the axial hole from a rear end side toward a leading end side in the axial direction;

a metal shell disposed on the outer periphery of the insulator; and the center electrode including a large diameter portion which is inserted into the axial hole and abuts against the in-axial-hole shoulder from the axial direction rear end side, a barrel portion that is smaller in diameter than the large diameter portion and is disposed closer to the axial direction leading end side than the large diameter portion, and small diameter portions which are disposed closer to the leading end side than the barrel portion, said small diameter portions being smaller in diameter than the barrel portion, the method comprising:

first step of preparing a cylindrical electrode member as the material of the center electrode;

second step of forming a medium diameter portion that is larger in diameter than the small diameter portions, and that extends from the leading end to the rear end of the electrode member, using an extrusion process;

a third step of forming the small diameter portions on the leading end side of the medium diameter portion using an extrusion process,; and a fourth step of forming the barrel portion by extruding the medium diameter portion, said fourth step being performed when the value of $((S1-S2)/S1)\times100$ is 30 or more, wherein S1 is the cross-sectional area of a cross section of the medium diameter portion perpendicular to the axial direction, and wherein S2 is the cross-sectional area of a cross-section of each small diameter portion perpendicular to the axial direction.

2. A method of manufacturing a spark plug including:

an insulator having an axial hole extending in an axial direction, the axial hole having an in-axial-hole shoulder which reduces the diameter of the axial hole from a rear end side toward a leading end side in the axial direction;

a metal shell disposed on the outer periphery of the insulator; and a center electrode including a large diameter portion which is inserted into the axial hole and abuts against the in-axial-hole shoulder from the axial direction rear end side, a barrel portion that is smaller in diameter than the large diameter portion and is disposed closer to the axial direction leading end side than the large diameter portion, small diameter portions which are disposed closer to the leading end side than the barrel portion, said small diameter portions being smaller in diameter than the barrel portion, the method comprising:

in steps of manufacturing the center electrode, first step of preparing a cylindrical electrode member as the material of the center electrode;

second step of forming a medium diameter portion that is larger in diameter than the small diameter portions, and that extends from the leading end to rear end of the electrode member, using an extrusion;

a third step of forming the small diameter portions on the leading end side of the medium diameter portion using an extrusion process; and a fourth step of forming the barrel portion by extruding the medium diameter portion to suppress any bulge in said medium diameter portion created by said third step of forming.

* * * * *